US005324218A

United States Patent [19]

Rijnders

[11] Patent Number: 5,324,218

[45] Date of Patent: Jun. 28, 1994

[54] APPARATUS FOR ADJUSTING THE LEVERAGE OF AN OAR OR SCULL WHILE ROWING

[76] Inventor: Carel J. Rijnders, Wilhelmina Druckerstraat 59, 2401 KH Alphen Aan Denk Rijn, Netherlands

[21] Appl. No.: 978,827

[22] Filed: Nov. 19, 1992

[51] Int. Cl.[5] ..... B63H 16/06

[52] U.S. Cl. ..... 440/107; 416/74; 440/106

[58] Field of Search ..... 440/101, 102, 103, 104, 440/105, 106, 107, 108, 109, 110; 441/13; 416/74

[56] References Cited

U.S. PATENT DOCUMENTS 826,058 7/1906 Pendleton ..... 440/107
3,108,565 10/1963 Cain .

FOREIGN PATENT DOCUMENTS 29512 6/1958 Finland ..... 440/102
47762 8/1936 France ..... 440/104
2423395 12/1979 France ..... 440/104
471718 9/1937 United Kingdom .

*Primary Examiner*—Michael S. Huppert
*Assistant Examiner*—Thomas J. Brahan
*Attorney, Agent, or Firm*—W. G. Fasse; W. F. Fasse

[57] ABSTRACT

An oar or scull is equipped with a movable sliding bushing or collar (2, 3) for adjusting the leverage while rowing. For this purpose a locking device (12) normally prevents the linear or axial movement of the oar shaft with a sliding sleeve (8) which is mounted on the oar shaft (1) relative to the locking device. By pushing a button (11) on the handle (10), the locking device (12) will allow a relative movement of approximately 2.5 mm at a time between the collar (3A, 3B) and the shaft (1). Releasing the button (11) allows again a movement of 2.5 mm, whereby a rower is able to adjust the leverage and thus the load while rowing.

20 Claims, 4 Drawing Sheets

APPARATUS FOR ADJUSTING THE LEVERAGE OF AN OAR OR SCULL WHILE ROWING

FIELD OF THE INVENTION

The invention relates to sculls and oars equipped with a mechanism for adjusting the leverage or mechanical advantage with which a rower can apply the oar or scull. Incidentally, the term "oar" and the term "scull" are used interchangeably herewith.

BACKGROUND INFORMATION

The leverage or mechanical advantage that a rower is able to use to his advantage in applying the oar is conventionally adjusted prior to a race or training run for a good efficiency. The leverage that can efficiently be applied depends greatly on the direction of the wind and other factors. If an incorrect selection is made initially, the race may be lost. A selection of an optimal value is not possible.

The term "leverage" or "mechanical advantage" as used herein means the ratio of a length A to a length B as will be explained in more detail below with reference to FIG. 1.

United Kingdom Patent No. 471,718 (Fraser), published on Oct. 7, 1937, describes an adjustable oar lock sleeve in the form of a tubular member provided with a flange, whereby the tubular member and the flange are made of rubber, leather, or other non-metallic material and split alongside with an open metal ring embedded in the flange. The purpose of the split is to fit the oar lock sleeve to any one of a number of standard oar sizes. Once the sleeve is attached, it is firmly secured to the oar without the need of nails or the like. The flange or collar is connected to the sleeve by at least one screw or by two screws. Once the screw is tightened an adjustment of the position of the sleeve along the oar is no longer possible. Thus, an adjustment of the leverage must always be made on shore prior to a race or training. A tool such as a screwdriver is needed for the purpose.

U.S. Pat. No. 3,108,565 (Kane), issued on Oct. 29, 1963, describes a sculling apparatus with an oar shaft that can be moved axially relative to a mounting mechanism if a stop sleeve with a stop screw are released. The stop screw has a knurled head and both hands are needed for making the adjustment. An adjustment while rowing is not possible.

The prior art does not permit a leverage adjustment while rowing and hence leaves room for improvement.

OBJECTS OF THE INVENTION

In view of the foregoing it is the aim of the invention to achieve the following objects singly or in combination:

- to allow an individual rower a selection between the available strength and the physical endurance by permitting an adjustment of the mechanical advantage while continuing the rowing motion;
- to permit an adjustment of the load during the rowing to the pace of the boat at any particular moment with due regard to the instantaneously prevailing operating conditions, such as wind conditions; and
- to permit the above mentioned adjustments with one hand from the handle of the oar without any tool while continuing the rowing motion.

SUMMARY OF THE INVENTION

According to the invention, the leverage of an oar is adjustable automatically during rowing by the temporary release of a locking device effectively interposed between the oar shaft at an oarlock engaging member for permitting the oar shaft to axially move relative to the oarlock engaging member. An operating device, for example, a Bowden cable or other suitable mechanism that can be activated by pushing a button with one finger at the oar handle enables the rower to temporary release the locking device for the desired adjustment without stopping the rowing.

More specifically, an oarlock engaging member according to the invention is slideably mounted on the oar shaft to permit an axial movement of the oar shaft relative to the oarlock engaging member. For this purpose a locking device is operatively interposed between the oarlock engaging member and the oar shaft for normally preventing a relative axial movement. A manually operable release mechanism including a release member, such as a push button operable by a finger of the hand that holds the oar handle, is connected to the locking device for temporarily releasing the locking device with one hand from the oar handle thereby permitting the axial movement of the oar shaft relative to the oarlock engaging member while continuing the rowing motion. Preferably, the locking device has a plurality of interlocking steps that are temporarily releasable by the release mechanism for a stepwise adjustment by the single-handed operation of the release member while rowing.

The movable oarlock engaging member is a bushing with a flange in contact with the oarlock. The bushing is locked to the oar shaft by a spring loaded locking device. When the flange is closer to the oar handle, the mechanical advantage for the rower becomes smaller, whereby the rowing becomes harder. However, the rower may now row respectively slower for achieving a desired rowing effect. On the other hand, when the flange is further away from the oar handle, the mechanical advantage for the rower increases, thereby making the rowing easier, but the rower must now row faster for achieving a desired rowing effect.

The rower is now able to determine or select the mechanical advantage by pressing a push button on the handle of the oar, whereby the locking device will partly lift out of a line of holes in the collar, thereby temporarily releasing the connection between the collar and the oar shaft to permit the oar shaft to move by a small axial distance relative to the bushing as determined by a play between a locking pawl and a hole in a first row of holes in a portion of the bushing. The movement is limited by the engagement of a further pawl of the locking device in another hole in a second line of holes extending in parallel to the first mentioned line of holes, but staggered relative to the first line of holes. Due to the staggering, the two lines of holes are axially displaced relative to one another by half the distance between the on-center spacing C of two holes in a line. By releasing the push button the locking device is again engaged in a hole next to the one in which the locking device was engaged prior to the adjustment step just performed to rigidly connect the bushing to the oar shaft.

BRIEF DESCRIPTION OF THE DRAWINGS

In order that the invention may be clearly understood, it will now be described, by way of example, with reference to the accompanying drawings, wherein.

DETAILED DESCRIPTION OF A PREFERRED EXAMPLE EMBODIMENT AND OF THE BEST MODE OF THE INVENTION

Figure 1:
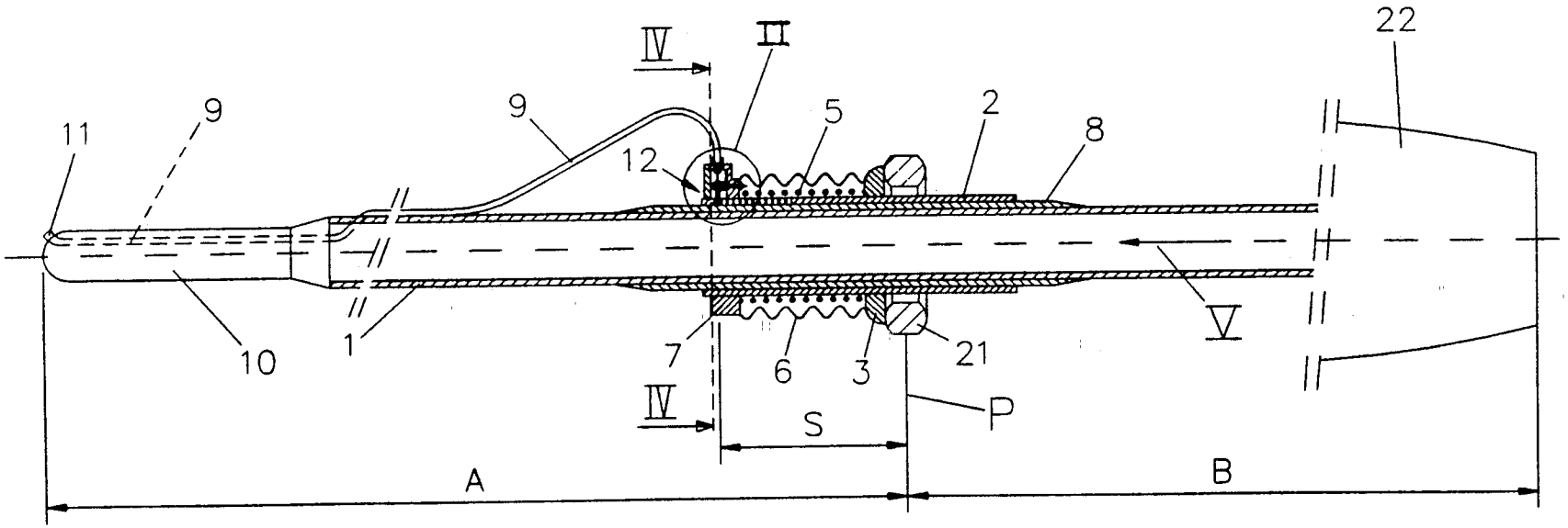
FIG. 1 is a longitudinal axial section through an oar shaft and through the adjustment device according to the invention.

Referring first to FIG. 1, the mechanical advantage corresponds to the ratio of the length A to the length B. The length A is defined as the distance between the end of the handle 10 and a plane P passing centrally through an oarlock 21. The length B is defined as the distance between the plane P and the end of the oar blade 22. According to the invention, the length A is variable to the extent a variable distance S can be varied by moving the oar shaft 1 in one or the other direction as indicated by the arrow A1 when a locking mechanism to be described in more detail below is released by operating a release mechanism 9, for example, a Bowden cable, through a push button 11 conveniently arranged at the handle 10 of the oar. The variable length S is defined as the distance between the plane P and a plane passing centrally through a collar or lock housing 7 forming part of a locking mechanism 12. The housing 7 is rigidly secured to the oar shaft 1.

Assuming the oar shaft 1 including the handle 10 and the blade 22 is 3 m long, the length A should be adjustable, e.g. within the range of 86 to 92 cm. The variable part of the distance S would then be within the range of 0 to 6 cm. As mentioned above, when the mechanical advantage or leverage is large, for example, A corresponds to 92 cm, the rowing is easier, but the rower must apply a higher pace, requiring a respective physical endurance, and the distance travelled per stroke is less than the distance when the leverage is lower with the distance A being 86 cm.

Referring further to FIG. 1, the oar shaft 1 is provided with a friction reducing slide sleeve 8 rigidly attached to the outer surface of the oar shaft 1. The slide sleeve 8 forms a second means in a group of three means that cooperate with each other and with further elements to achieve the above stated purpose or objects of the invention. The slide sleeve 8 is made of a material having a low friction coefficient for example polytetrafluoroethylene. The slide sleeve 8 enables the shaft 1 to be moved axially back and forth as indicated by the double arrow A1 when the locking mechanism is temporarily released. First means, for example, in the form of a sliding bushing 2 has secured thereto a flange 3 that rests against the oarlock 21 that defines a plane P passing centrally through an engagement area where the oar shaft 1 engages an oar lock 21. The locking mechanism 12 shown in greater detail in FIGS. 2, 3, and 4 includes a lock housing 7 that forms third means of the above mentioned three means. The lock housing is rigidly secured to the oar shaft 1 as will be described below for applying an adjustment force between the oar shaft 1 and the sliding bushing 2 when the lock release device 9, such as a Bowden cable is operated by the push button 11. A compression spring 5 providing a biasing force, is arranged between the flange 3 and the lock housing 7. The biasing spring 5 exerts an adjustment force between the flange 3 and the lock housing 7 in the longitudinal axial direction. The repeated operation of the push button 11 permits the adjustment of a plurality of axial spacings in sequential steps, as will be described in more detail below. The radially extending flange 3 of the sliding bushing 2 has an axially facing flat surface for engaging the oarlock 21 which is shown in an exaggerated size relative to the size of the other components. The fit between the inner surface of the bushing 2 and the outer surface of the slide sleeve 8 is a sliding fit to permit the axial adjustment of the oar shaft 1 relative to the oar lock 21 to vary the ratio A to B.

The locking mechanism 12 that is connected through the Bowden cable 9 to the push button 11 will now be described with reference to FIGS. 2, 3, and 4. The locking device 12 includes the lock housing 7 having two housing sections 7A and 7B clamped onto the oar shaft 1, or rather onto the slide sleeve 8 in a force-transmitting location fit by nuts and bolts 18. The housing 7 forms a chamber 7D closed by a cover 14. An opening 7C in the housing section 7B permits the sliding movement of the shaft 1 with its sleeve 8 relative to a tongue 2B of the sliding bushing 2. Similarly, a sliding fit is provided between the housing section 7A of the collar or housing 7 and the tongue 2A of the sliding bushing 2. Both tongues 2A and 2B also are permitted to slide axially relative to the cover 14 of the lock housing 7.

Figure 4:
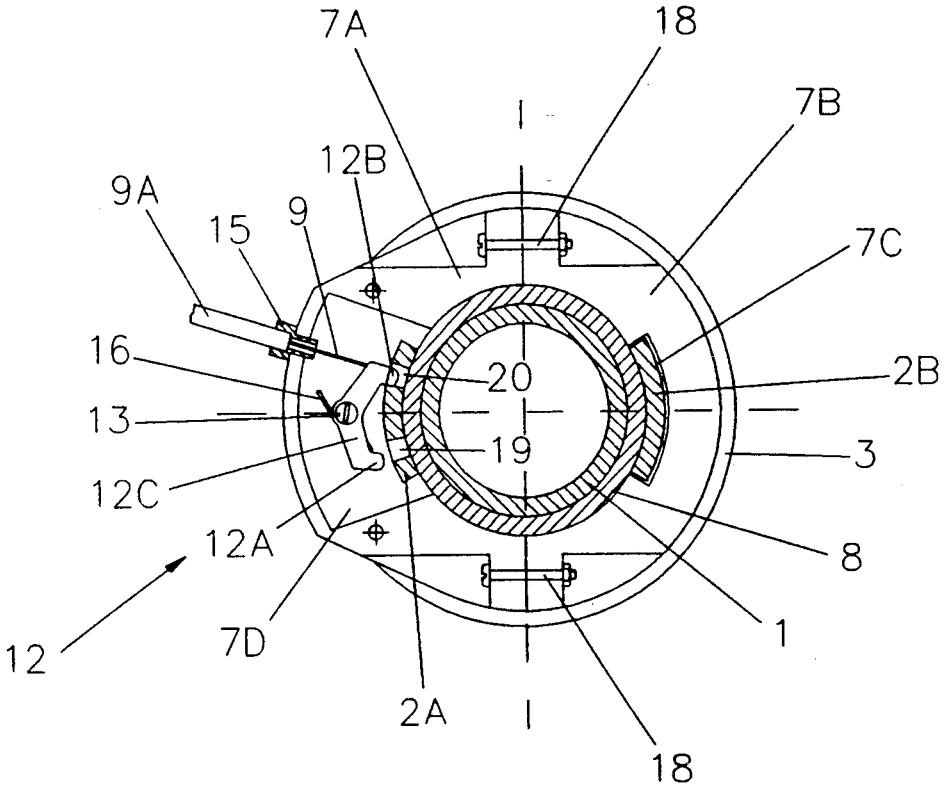
FIG. 4 is a sectional view, on an enlarged scale, along section plane IV—IV in FIG. 1.

As shown in FIG. 4, the locking mechanism 12 comprises a rocking lever 12C having two locking pawls 12A and 12B. The rocking lever 12C is journalled on a reduced diameter bushing section 17A of a bushing 17 mounted to the housing 7 by a bolt 13 and a nut 13A. The bolt 13 passes through the bushing 17, which carries a torsion spring 16 secured with one end 16A to the rocking lever 12C and with the other end 16B to the housing 7. The spring 16 biases the rocking lever 12C so that its pawl 12B tends to engage a hole 20 to be described in more detail below. The axial length D of the reduced diameter section 17A of the bushing 17 is slightly longer than the width of the rocking lever 12C to permit the free journalling of the rocking lever 12C about the axis of the bolt 13 to the extent permitted by the torsion spring 16.

Figure 2:
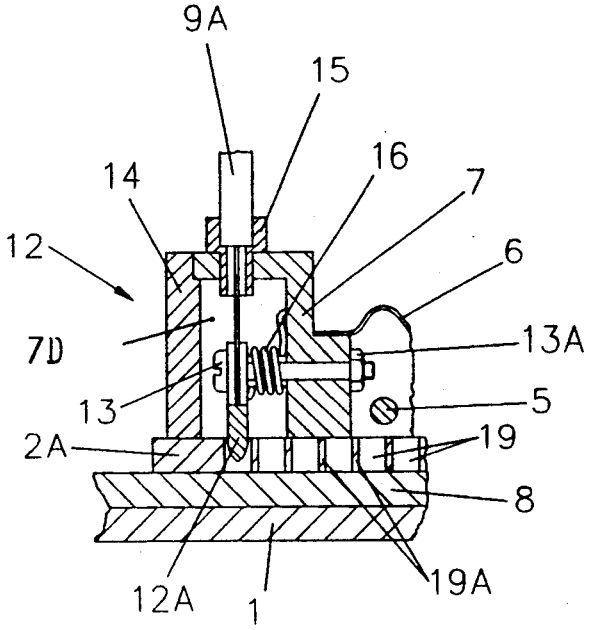
FIG. 2 shows, on an enlarged scale, the detail II of FIG. 1.
Figure 3:
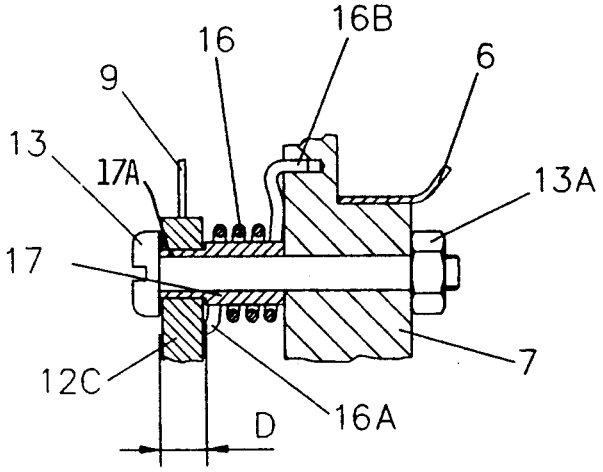
FIG. 3 shows a sectional view through a journal mounting permitting the rocking movement of a spring biased locking pawl.

As shown in FIGS. 2, 3, and 4, the end of the Bowden cable 9 is connected to the rocking lever 12C and passes through a cable sheath 9A to the push button 11. A cable adjustment member 15 of conventional construction secures the end of the cable sheath 9A to the housing section 7A. The proper length of the cable 9 is conventionally adjusted by the member 15. When the cable 9 is pulled by pushing the button 11, the rocking lever 12C tilts counterclockwise, thereby withdrawing the pawl 12B from the respective hole 20 while permitting the temporary insertion of the pawl 12A into a respective hole 19. When the button 11 is released, the spring 16 will cause the engagement of the pawl 12B with the next hole 20, as will be described in more detail below with reference to FIG. 6. Neighboring holes 19 in a row are spaced from each other by a spacer land 19A. Similarly, holes 20 in a row are spaced from one another by a respective spacer land not seen in FIG. 2.

Figure 5:
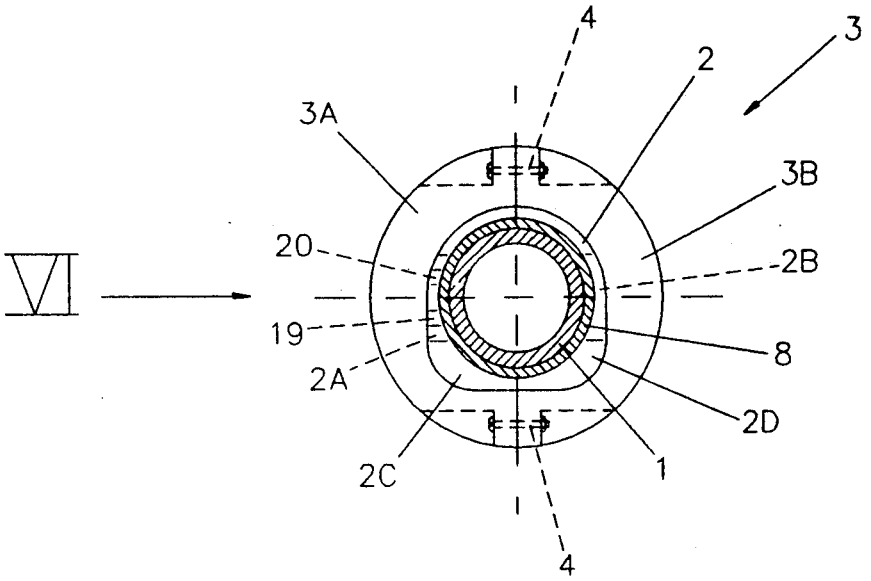
FIG. 5 is an axial view, approximately in the direction of the arrow V in FIG. 1, of the sliding bushing with its flange, whereby the oar shaft and a sliding sleeve are shown in section.

Referring to FIG. 5, the flange 3 is rigidly clamped onto the sliding bushing 2. For this purpose, the flange 3 has two flange sections 3A and 3B held together by nuts and bolts 4. The connection between the flange sections 3A, 3B and the sliding bushing 2 is provided by a force transmitting fit or the bushing 2 with its tongues 2A and 2B can be constructed as an integral part of the flange sections. In any event, the sliding fit between the sliding bushing 2 and the slide sleeve 8 permits the required relative movement between the oar shaft 1 and the sliding bushing 2 with its flange 3. Eccentric portions 2C and 2D make sure that the orientation of the blade in the water is correct (blade angle) when facing a similar portion of the oar lock 21.

Figure 6:
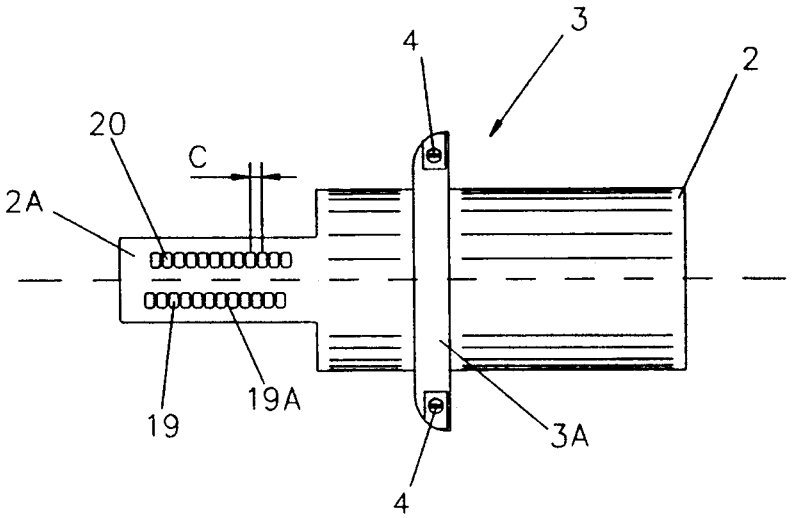
FIG. 6 is a view of the sliding bushing and its flange in the direction of the arrow VI in FIG. 5.

FIG. 6 shows a side view of the sliding bushing 2 as viewed in the direction of the arrow VI in FIG. 5. Two rows of holes 19 and 20 are provided in the bushing tongue 2A. The tongue 2B does not have any holes. The on-center spacing between neighboring holes is C.

Referring to FIG. 4, the lock housing 7 with its housing section 7A and 7B forms a collar around the oar shaft 1, while clamping the sliding sleeve 8 between the shaft 1 and the collar 7 by tightening the nuts and bolts 18.

The above mentioned spring 5 is a helical compression spring that surrounds the oar shaft 1 for bearing against the flange 3 and against the collar or housing 7, and the respective biasing force is such that the collar 7 and the flange 3 are forced away from each other to increase the spacing S between the flange 3 and the collar or housing 7. As shown, the spacing S is increased by the force of the spring 5 when the locking mechanism 12 is released. However, when the locking mechanism is released, the spacing S can also be reduced by the action of the rower against the force of the spring 5 as will be described below.

As shown in FIG. 4, the pawls 12A and 12B have tapering ends fitting with play into the respective spacer hole 19 or 20 so that the spacing S is changed to the extent of the play and so that the proper pawl fully engages a next spacer hole before one pawl fully clears the respective previous spacer hole, whereby a stepwise change of the spacing S takes place with each activation of the button 11. For this purpose, the holes 20 in one row are axially displaced with regard to the holes 19 in the other row. This axial displacement corresponds to one half of the on-center hole spacing C.

The on-center spacing C is, for example, 5 mm. The tapering of the pawls 12A and 12B starts, for example, at a pawl diameter of 4.5 mm, and ends in a sharp point. Thus, when the button 11 is depressed, the collar or lock housing 7 and with it the oar shaft 1 will move slightly in one direction as permitted by the play and caused by the spring 5, whereby the pointed end of the other pawl will enter the other line of holes. Fully depressing the button 11 causes the other pawl 12A to fully move into the respective next hole, whereby the adjustment was 2.5 mm, namely one half of the on-center spacing C. The same operation takes place when the button is released again, whereby the pawl 12B enters into the next hole in its row, again allowing a 2.5 mm adjustment in the axial direction. As shown, the bias of the spring is such that the length A is increased when the button is depressed, thereby making the rowing easier. Such adjustment is even possible during the rowing stroke with the blade 22 is in the water or during the recovery stroke with the blade 22 out of the water.

To reduce the length A by moving the collar or housing 7 against the force of the spring 5, the rower will again push the button 11 just as soon as the blade 22 has again entered the water, beginning a new stroke after the so-called "catch". At that moment the oar shaft assumes an angle relative to the longitudinal center-line of the boat within the range of about 20° to about 40°. The force of the rower extends substantially along this boat centerline. The rowing force is divided into two components. One force component extends at 90° to the oar shaft 1, while the other component extends along the oar shaft toward the oarlock 21. When this last mentioned force component is larger than the force of the spring 5, the lock housing 7 will be pushed toward the flange 3, while the pawls 12A, 12B are disengaged. The force component toward the oarlock is normally large enough to overcome the force of the spring 5 just after the so-called "catch", whereby the housing 7 will move toward the flange 3 as just described, reducing the mechanical advantage and thus making the rowing harder. The distance S has become shorter.

It should be mentioned here, that the tapering of the pawls 12A, 12B is such that before one pawl is fully lifted from a hole, the other pawl end fits into its respective hole, so that there is no position of the rocking lever 12C in which both pawls 12A and 12B are fully lifted out of the holes in the sleeve tongue 2A simultaneously. Further, the formation of the tongues 2A and 2B make sure that any rotation of the sleeve 2 around the sliding element 8 is prevented to properly position the rows of holes 19, 20.

The above mentioned on-center spacing C of 5 mm and the resulting adjustment steps of 2.5 mm are merely an example, and other spacings and adjustment steps could be employed by changing the tapering and dimensions of the locking pawls 12A, 12B. In the shown example, a pushing and release of the button 11 will result in a total adjustment of 5 mm in two steps of 2.5 mm each.

The locking mechanism, also referred to as switching mechanism 12, in the housing or collar 7 is protected against the entrance of dirt by the cover 14 conventionally secured to the housing sections 7A and 7B. Similarly, the spring 5 is protected by a bellows type elastic sleeve 6 made of rubber or similar suitable material.

The above mentioned axial length D of the reduced diameter portion 17A of the bushing 17 makes sure that the rocking lever 12C is free to journal around the axis of the bolt 13, even if the latter is fully tightened. Similarly, the spring 16 is free to move independently of the tightening of the nut 13A on the bolt 13.

In order to accommodate the above mentioned total adjustment of 6.0 cm in several steps by pushing and releasing the button 11, it has been found to be convenient to provide twelve holes 19 in one row and twelve holes 20 in the other row, with the above mentioned on-center spacing C of 5 mm, for example, and with staggering of 2.5 mm.

It has been found to be advantageous to initially set the locking mechanism 12 so that the length A is 89 cm. In other words, the locking mechanism engages the holes in the middle between the ends of the row of holes. This initial setting allows for a maximum adjustable range while rowing, in one or the other direction.

However, the initial setting may differ in accordance with the type of boat involved, for example, a double rower or a quadruple rower. In a double rower an initial setting of A=88 cm and in a quadruple rower an initial setting of A=87 cm has been found to be satisfactory.

Incidentally, the push button 11 with its cable 9 can be replaced by an electric system with an electrical wiring from an electrical switch replacing the button 11 in a circuit of a solenoid operated by a battery. The battery may be installed in the hollow oar shaft 1 and the solenoid will be installed in the lock housing 7 to operate an armature to which the rocking lever 12C is connected.

Although the invention has been described with reference to specific example embodiments it will be appreciated that it is intended to cover all modifications and equivalents within the scope of the appended claims.

What I claim is:

1. An apparatus for adjusting a leverage of an oar, comprising an oar shaft (1) having a handle at one end and an oar blade at the other end, first means (2, 3) for defining an engagement area where said oar shaft (1) engages an oarlock, second means (8) for slidingly mounting said first means on said oar shaft, whereby relative longitudinal movement is possible between said first means (2, 3) and said oar shaft (1), third means (7) rigidly secured to said oar shaft for applying an adjustment force between said first means and said third means, biasing means (5) interposed between said first and third means for exerting said adjustment force at least in one longitudinal axial direction, locking means (12) for locking said first means (2) and said third means (7) relative to each other at any axial spacing (S) of a plurality of axial spacings from each other, and operating means (9, 11) operable by a rower with one hand while continuing rowing with said one hand for releasing said locking means to permit a change in said spacing, whereby said leverage is adjustable while rowing.

2. The apparatus of claim 1, wherein said first means comprise a sliding bushing (2) and a flange (3) connected to said sliding bushing (2) and extending radially outwardly from said sliding bushing (2), said flange (3) having a surface facing axially for engaging said oarlock, said sliding bushing (2) being mounted on said oar shaft with an axial sliding fit.

3. The apparatus of claim 2, wherein said flange (3) comprises two flange sections (3A, 3B) and means (4) for rigidly interconnecting said two flange sections to each other and to said sliding bushing (2), whereby said flange is slidable with said sliding bushing axially relative to said oar shaft.

4. The apparatus of claim 2, wherein said second means (8) comprise a slide sleeve (8) interposed between said oar shaft (1) and said sliding bushing (2) for reducing friction between said oar shaft and said sliding bushing (2).

5. The apparatus of claim 4, wherein said slide sleeve (8) is made of a synthetic material having a low friction coefficient, said sleeve (8) being rigidly secured to said oar shaft (1).

6. The apparatus of claim 1, wherein said third means (7) comprise a fixed collar (7) and means (18) for rigidly mounting said fixed collar to said oar shaft (1).

7. The apparatus of claim 6, wherein said fixed collar (7) comprises two collar shells (7A, 7B) and wherein said means (18) for rigidly mounting interconnect said collar shells (7A, 7B) to each other and to said oar shaft.

8. The apparatus of claim 6, wherein said biasing means comprise a helical compression spring (5) surrounding said oar shaft and bearing with one spring end against said first means (3) and with the other spring end against said fixed collar (7) of said third means, whereby said compression spring normally biases said first and third means axially away from each other to increase a spacing (S) between said first means (2, 3) and third means (7).

9. The apparatus of claim 1, wherein said locking means comprise double pawl means (12), journal means (13, 17) secured to said third means, for journalling said double pawl means (12) to said third means (7), further biasing means (16) connected to said double pawl means (12) for normally engaging said first means (2) for maintaining said axial spacing (S) between said first means (2) and said third means (7), and wherein said operating means (9, 11) are connected to said double pawl means (12) for temporarily disengaging said double pawl means from said first means (2) against the force of said further biasing means (16) for changing said spacing (S).

10. The apparatus of claim 9, wherein said change of said spacing (S) is caused by said first mentioned biasing means (5).

11. The apparatus of claim 9, wherein said change of said spacing (S) is caused by a rower by applying an axial force component to said oar shaft while disengaging said double pawl means.

12. The apparatus of claim 9, wherein said further biasing means is a torque spring (16) for keeping said double pawl means (12) in engagement with said first means.

13. The apparatus of claim 9, wherein said first means (2, 3) comprise a sliding bushing (2) having a radially outwardly extending flange (3) rigidly secured to said sliding bushing (2) and axially extending bushing tongue means (2A, 2B), two axially extending rows (19, 20) of spacer holes in said tongue means for engagement by said double pawl means (12), wherein said third means (7) comprise a fixed collar forming a housing for said double pawl means mounted in said housing on said journal means (13, 17), said housing having at least one opening therein for said tongue means to freely pass through said at least one opening.

14. The apparatus of claim 13, wherein said journal means comprise a journal bolt (13) and a journal bushing (17) on said journal bolt, said journal bushing having two sections with different outer diameters, said further biasing means being positioned on one of said journal bushing sections, said double pawl means being positioned on the other of said journal bushing sections, whereby said further biasing means and said pawl means are free to rotate on said journal bushing.

15. The apparatus of claim 13, wherein said journal bushing has a smaller outer diameter section rotatably carrying said pawl means, and a larger diameter section rotatably carrying said further biasing means in the form of a torque spring that biases said pawl means into engagement with at least one of said spacer holes at a time.

16. The apparatus of claim 13, wherein said double pawl means comprise a rocking lever (12) having two prongs, one prong being positioned at each end of said rocking lever, each prong having a tapering end that fits with play into said spacer holes when one of said prongs is partly withdrawn from a respective spacer hole, so that said spacing (S) is changed to the extent of said play and so that the other of said prongs fully engages a next spacer hole before said one prong fully clears the respective spacer hole, whereby a stepwise change of said spacing (S) takes place with each activation of said operating means (9, 11).

17. The apparatus of claim 16, wherein said operating means comprise a Bowden cable (9) and an activating member (11) located at said handle and connected to one end of said Bowden cable, another end of said Bowden cable being connected to said rocking lever (12) for rocking said rocking lever (12), whereby each activation and release of said activating member (11) results in an adjustment of said spacing (S) by one spacing step (C).

18. The apparatus of claim 13, wherein each of said two axially extending rows (19, 20) of said spacer holes comprises a plurality of spacer holes with a uniform on-center spacing step (C) between neighboring spacer holes, and wherein said spacer holes in one row are axially staggered by one half of said spacing step (C) relative to the spacer holes in the other row.

19. An apparatus for adjusting a leverage of an oar, comprising an oar shaft (1) with a handle (10) at one end and with an oar blade (22) at the other end, an oarlock engaging member (2, 3) slideably mounted on said oar shaft (1) to permit an axial movement of said oar shaft relative to said oarlock engaging member (2, 3), locking means (12) operatively interposed between said oarlock engaging member and said oar shaft for normally preventing said axial movement, and manually operable release means connected to said locking means for temporarily releasing said locking means with one hand from said handle (10) for permitting said axial movement while continuing rowing with said one hand.

20. The apparatus of claim 19, wherein said locking means comprise a plurality of interlocking steps temporarily releasable by said release means for a stepwise adjustment while rowing.

* * * * *